United States Patent [19]

Ferguson

[11] Patent Number: 4,842,002

[45] **Date of Patent: * Jun. 27, 1989**

[54] FLUSHING ADAPTOR AND METHOD OF MANUFACTURE

[76] Inventor: James A. Ferguson, 5016 Calle Minorga, Sarasota, Fla. 34242

[ * ] Notice: The portion of the term of this patent subsequent to Mar. 8, 2005 has been disclaimed.

[21] Appl. No.: 191,908

[22] Filed: May 9, 1988

[51] Int. Cl.[4] ..... B08N 3/02

[52] U.S. Cl. ..... 134/167 R; 134/183; 134/199; 440/88

[58] Field of Search ..... 134/167 R, 169 A, 182, 134/183, 199; 440/88, 900

[56] References Cited

U.S. PATENT DOCUMENTS

| | | | |
|---|---|---|---|
| 2,611,631 | 9/1952 | Benson | 440/88 X |
| 2,748,742 | 6/1956 | Morris | 440/88 |
| 3,003,456 | 10/1961 | Crozier | 440/88 |
| 3,421,527 | 1/1969 | Dettman | 134/199 X |
| 3,918,987 | 11/1975 | Kopfer | 134/199 X |
| 4,052,953 | 10/1977 | Patel | 134/167 R |
| 4,065,325 | 12/1977 | Maloney | 134/167 R |
| 4,121,948 | 10/1978 | Guhlin | 134/167 R |
| 4,246,803 | 1/1981 | Reese | 440/88 |
| 4,540,009 | 9/1985 | Karls | 134/199 X |
| 4,589,851 | 5/1987 | Karls | 440/88 |
| 4,729,393 | 3/1988 | Ferguson | 134/167 R |

*Primary Examiner*—Philip R. Coe
*Attorney, Agent, or Firm*—Charles J. Prescott

[57] ABSTRACT

A releasably retainable fresh water flushing adaptor for outboard and stern-drive marine propulsion systems having an external lower propulsion housing which includes at least one water intake port along or immediately adjacent either side of the upper forwardly bulbous portion of the lower housing. The flushing adaptor includes a molded cover which is mateably, releasably seal-retaining over this forwardly portion of the lower housing and also includes a fitting connected or connectable into the upper forwardly portion of the cover for releasable attachment to a supply of fresh water. The fitting has an internal passage in alignment and in fluid communication with the housing water intake port. At least one water distribution groove formed into the interior surface of the cover adjacent the fitting for providing water flow one both water intake port is also provided. Releasable strap means either connected to or completely circumscribing lower housing and cover may also be provided to eliminate any tendency for the cover to be forced from disengagement with the lower housing by engine vibration or water pressure.

9 Claims, 1 Drawing Sheet

FLUSHING ADAPTOR AND METHOD OF MANUFACTURE

BACKGROUND OF THE INVENTION

This invention relates generally to accessories for marine engines, and more particularly to adaptors or attachments for fresh water flushing of marine engines having lower housings such as those found in outboard and stern-drive engines, representing a further improvement in my U.S. Pat. No. 4,729,393.

It is well known that marine engines operating in contaminated and/or salt water conditions should be periodically flushed with fresh water to reduce contaminant and salt build-up within the water passages of the engine. In conjunction with boats which are regularly removed from the water, then, having a means for introducing a supply of fresh water into the engine while it is operating otherwise out of water serves as an excellent preventive maintenance measure.

Until recently, all outboard engines included water intake ports which were positioned in the lower unit and the sides of the housing, in opposing fashion. These water intakes were so positioned at a midpoint in the depth or fore-and-aft dimension of the lower unit to reduce the possibility of foreign objects in the water such as plastic or paper sheet material becoming lodged around the lower unit and impeding water flow into these water intakes. These opposing water intakes lend themselves easily and conveniently to well-known flushing adaptors such as those disclosed in U.S. Pat. Nos. 2,661,631, 3,931,828, 4,108,190 and 4,359,063. All of these devices variously direct water into water intakes which are opposingly positioned in the mid-portion of the lower housing.

However, as small boats are being propelled faster with modern engines, particularly outboard and stern-drive engines of higher horsepower, as the speed of these boats approaches a certain critical speed, the shape of the lower unit, particularly the bulbous leading portion of the lower unit, has had to be redesigned to improve the high speed water penetrability of these housings through the water. It has been found that at these certain higher speeds, standard housing designs cause water separation from the lower housing surface, reducing or eliminating cooling water into these water intakes and also reducing available water flow to the propellers for propulsion.

In conjunction with these radically redesigned lower housings which include extended and sharply pointed forwardly portions for more efficiently travelling through water at high speed, the position of the water intake has therefore also required relocation. Typically, this repositioning of the water intake is to the lower or upper forwardly surface of the bulbous now pointed portion of the lower housing. These water intakes are typically disposed symmetrically about the plane passing through the center of the housing into a concave or convex surface and do not lend themselves to convenient fresh water flushing. None of the inventions described above are adaptable to provide a supply of fresh water into these so repositioned water intakes to accomplish this preventive maintenance flushing except for my previous '393 patent which accommodates high performance units with lower forwardly positioned water intakes.

The present invention provides such a flushing adaptor which is adapted to be releasably installable around the forwardly portion of the revised, extended lower unit design and includes fitting means positioned therewith so as to introduce a supply of fresh water into and in fluid communication with these new upper forwardly positioned water intakes.

BRIEF SUMMARY OF THE INVENTION

The present invention is directed to a releasably retainable fresh water flushing adaptor for outboard and stern-drive marine propulsion systems having an external lower propulsion housing which includes at least one fresh water intake port along or adjacent the upper forwardly pointed bulbous portion of the lower housing. The flushing adaptor includes a molded cover which is mateably, releasably self-retaining over this forwardly portion of the lower housing and also includes a fitting connected or connectable into the upper forwardly portion of the cover for releasable attachment to a supply of fresh water. The fitting has an internal passage in alignment and in fluid communication with the housing water intake port. A water distribution groove formed into the interior surface of the cover adjacent the fitting for providing water flow into at least one water intake port is also provided. Releasable strap means either connected to or completely circumscribing lower housing and cover may also be provided to eliminate any tendency for the cover to be forced from disengagement with the lower housing by engine vibration or water pressure.

It is therefore an object of this invention to provide a flushing adaptor which is releasably installable onto the forwardly pointed portion of the lower drive unit housing of high performance marine engines so as to provide fresh water flushing of the propulsion system.

It is another object to provide the above invention which is particularly adaptable to modern lower housings which include water intake ports at or adjacent the upper forwardly bulbous portion of the lower housing.

In accordance with these and other objects which will become apparent hereinafter, the instant invention will now be described with reference to the accompanying drawings in which:

DETAILED DESCRIPTION OF THE INVENTION

Figure 1:
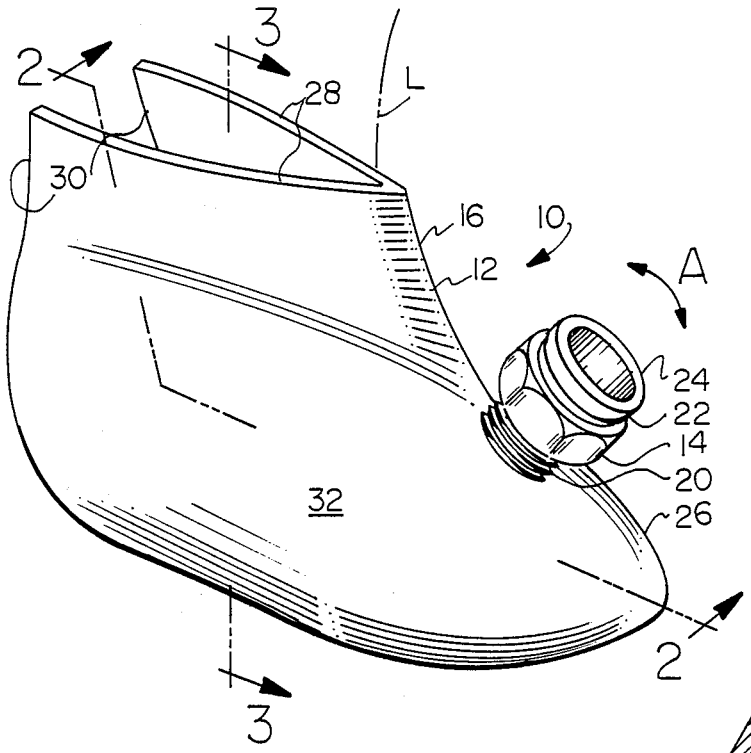
FIG. 1 is a perspective view of the invention.
Figure 3:
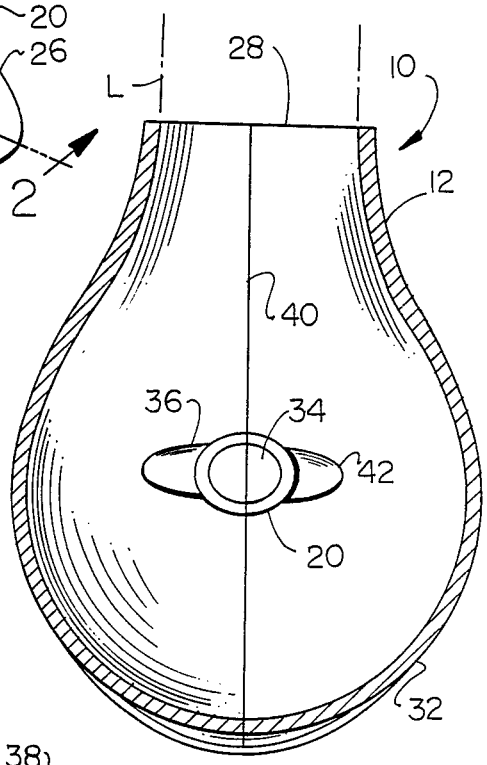
FIG. 3 is an end elevation section view in the direction of arrows 3—3 in FIG. 1.
Figure 2:
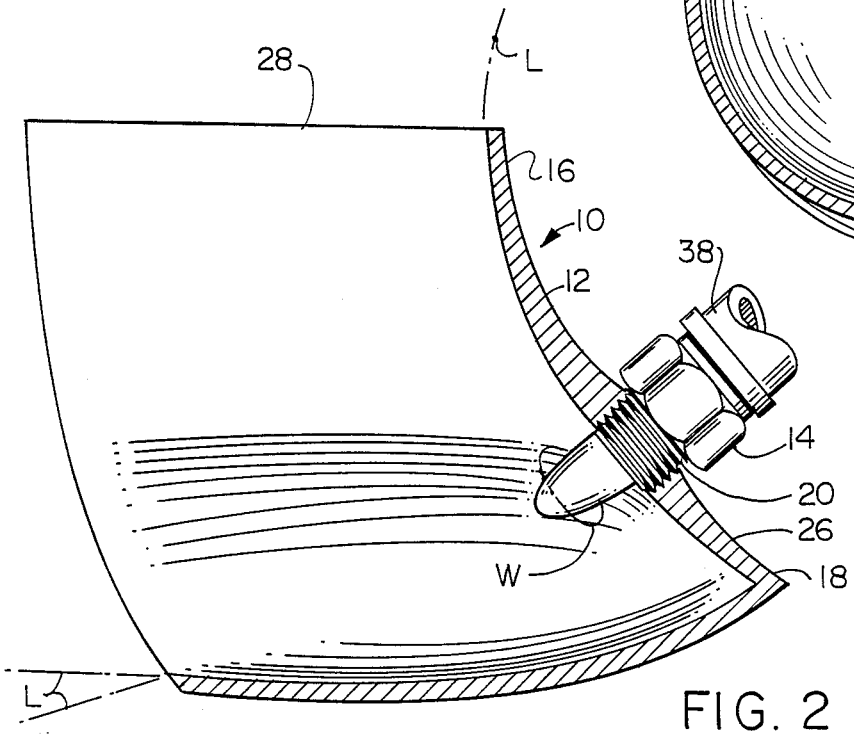
FIG. 2 is a side elevation section view in the direction of arrows 2—2 in FIG. 1.

Referring now to the drawings, the invention is shown generally at numeral 10 and includes a hollow molded cover or shell 12 and a fitting 14 which is connected thereto. The cover 12 is integrally molded of, preferably fiberglass material and includes a main portion 32 having an extended bulbous portion 18 blending into a narrower upper portion 16. Top opening 28 and back opening 30 are contiguous and sized to receive and fit around the lower housing L. Line 40 represents the mating contour against the pointed forwardly and bottom edges of lower housing L. Fitting 14 is connected to the cover 12 at or adjacent the upper portion of the forwardly extending bulbous portion 18. This fitting 14 may either be permanently connected into the somewhat thickened portion 26 or may be threadably engagable into thickened portion 26 by threaded portion 20 as shown. The fitting 14 includes connector portion 22 which rotates in either direction A and includes raised knurled portion 24 which facilitates its connection onto the male end of a typical garden hose. The garden hose, of course, is connected to a supply of fresh water.

Fitting 14 includes thru-passage 34 which provides fluid communication between the water supply and the interior of the cover 12. This invention is particularly adapted to lower units which include water intake ports W which are disposed on either side of the lower housing L on or immediately adjacent the upper forward pointed portion of the lower housing L. These water intake posts W are generally disposed symetrically about the center plane of the lower housing L and may include one or more openings therewith. These water intake ports W are typically elongated and diagonally disposed. Two water distribution grooves 36 and 42 are provided which effect fluid communication between passageway 34 and the water intake ports W and eliminate the possibility of reduced water flow into the water intake ports W because the fitting 14 has been less than precisely aligned and positioned in cover 12.

These water distribution grooves 36 and 42 may either be ground into the interior surface of cover 12 or integrally formed therein as cover 12 is fabricated.

It should be noted that fitting 14 may be positioned in cover 12 directly adjacent only one water intake port W if desired.

Method of Manufacture

The most accurate way to fabricate the cover 12 is by using an actual lower housing L as a mold. The lower housing L may be first coated with a releasing agent to prevent adhesion of the ingredients to be applied thereto. Next, the water intakes W must be blocked so that none of the ingredients will enter into and plug any of these intakes. This may be done by applying tape, or, alternately, a small adhesive mold which has the size and shape of the water distribution grooves 36 and 42 may be applied over these water intakes W for accurate placement of these water distribution grooves 36 and 42 in the cover 12. A combination of fiberglass mat and roving and polyester resin is then applied over the lower housing L in a well known manner at least covering the forwardly portion of the lower housing L in the shape of cover 12 as shown. After sufficient build-up of these ingredients has been applied, particularly adding build-up material at area 26 to receive fitting 14 and its threaded portion 20, the entire applique is allowed to cure and harden.

After curing has been effected, the molded cover 12, having excess material beyond that shown, is removed. The edges to openings 28 and 30 are then trimmed and smoothed to reduce burs and enhance appearance.

Fitting 14 is then either threadably engaged into a suitably threaded aperture in the cover 12 at 26 or may alternately be permanently bonded into a suitably prepared aperture in the cover 12. Placement of the fitting is important so as to properly align water passage 34 in relation to the water intakes W as previously described. If water distribution water grooves 36 and 42 have not been integrally molded, they must, likewise be ground into the cover 12 prior to installing fitting 14.

By molding the cover 12 directly over the lower housing L in this manner, the inner surface of cover 12 will virtually identically match and mate with the outer surface of the lower housing L. This has the two fold benefit of both providing increased releasable retainment of the cover on the lower housing L during operation and, secondly, to all but eliminate any water leakage from between the lower housing L and the inner surface of cover 12. Thus, virtually all water entering passage 34 and water distribution grooves 36 will be forced to enter into the water intakes W of the lower housing L for maximum engine cooling.

Although not shown in the drawings, where the mating fit between the inner surface of the cover 12 and the lower housing L is less than substantially perfect, a length of strap material may be used to wrap around both lower housing L and installed flushing adaptor 10 to reduce both leakage and to counter water thrust and engine vibration which would otherwise tend to disengage the cover 12 from the lower housing L. Releasable interconnection means such as Velcro or mating snaps will render the strap releasably securing for this purpose. Alternately, two separate lengths of master strip material may be connected at one end to opposing sides of the cover and wrapped in securing fashion around the lower housing L then releasably interconnected against one another by Velcro or the like.

While the instant invention has been shown and described herein in what is conceived to be the most practical and preferred embodiment, it is recognized that departures may be made therefrom within the scope of this invention, which is therefore not to be limited to the details disclosed herein, but is to be accorded the full scope of the claims so as to embrace any and all equivalent apparatus and articles.

What is claimed is:

1. A fresh water flushing adaptor for outboard and stern-drive marine engines having an external lower propulsion housing which includes a bottom forwardly pointed portion on the lower propulsion housing which further includes at least one water intake port along or immediately adjacent either side of the upper forwardly pointed portion of the lower housing, said flushing adaptor comprising:

a molded cover adapted to substantially mateably encase the forwardly pointed portion of the lower housing including at least one water intake port on the upper portion thereof such that said cover is releasably retainable over the forwardly portion of the lower housing;

fitting means connected to the upper forwardly portion of said cover for releasable attachment to a supply of water;

said fitting means having internal passages in registry and fluid communication with at least one water intake port for conveying water into said cover and into the water port intake.

2. A fresh water flushing adaptor as set forth in claim 1, wherein said cover also includes:

at least one water distribution groove in the interior surface of said cover adjacent said fitting means and said internal passage for facilitating water flow into at least one water intake port.

3. A fresh water flushing adaptor as set forth in claim 2, wherein:

said cover is integrally mold formed over the forwardly portion of the lower housing such that said cover interior surface identically conforms to the exterior surface contour of the forwardly portion of the lower housing, providing increased retention of said cover and reduced water leakage from the flow of water from said internal passage into at least one water intake port.

4. A fresh water flushing adaptor as set forth in claim 3, wherein:

said cover is integrally mold formed of polyester resin and fiberglass.

5. A fresh water flushing adaptor for outboard and stern-drive marine engines having an external lower propulsion housing which includes a bottom forwardly pointed portion on the lower propulsion housing which further includes at least one water intake port along or immediately adjacent either side of the upper forwardly pointed portion of the lower housing, said flushing adaptor comprising:

a molded cover adapted to substantially mateably encase the forwardly pointed portion of the lower housing including the water intake port on the upper portion thereof such that said cover is releasably retainable over the forwardly portion of the lower housing;

fitting means releasably connectable to the upper forwardly portion of said cover for releasable attachment to a supply of water;

said fitting means having an internal passage in registry and fluid communication with the water intake port for conveying water into said cover and into the water intake port.

6. A fresh water flushing adaptor as set forth in claim 5, wherein said cover also includes:

at least one water distribution groove in the interior surface of said cover adjacent said fitting means for facilitating water flow into each water intake port.

7. A fresh water flushing adaptor as set forth in claim 6, wherein:

said cover is integrally mold formed over the forwardly portion of the lower housing such that said cover interior surface identically conforms to the exterior surface contour of the forwardly portion of the lower housing and providing increased retention of said cover and reduced water leakage from the flow of water from said internal passage into the water intake port.

8. A fresh water flushing adaptor as set forth in claim 7, wherein:

said cover is integrally mold formed of polyester resin and fiberglass.

9. A fresh water flushing adaptor as set forth in claim 1, further comprising:

strap means for releasably additional securing of said cover in mateable encasing position over the forwardly portion of the lower housing.

* * * * *